US006386250B1

(12) United States Patent
Liu

(10) Patent No.: US 6,386,250 B1
(45) Date of Patent: May 14, 2002

(54) HELICAL KNIFE ASSEMBLY

(76) Inventor: Hsing-Chao Liu, 58, Ma Yuan West St., Taichung (TW)

( * ) Notice: Subject to any disclaimer, the term of this patent is extended or adjusted under 35 U.S.C. 154(b) by 0 days.

(21) Appl. No.: 09/704,365

(22) Filed: Oct. 30, 2000

(51) Int. Cl.[7] ..... B27C 5/00

(52) U.S. Cl. ..... 144/231; 144/229; 144/230; 407/49; 407/108

(58) Field of Search ..... 144/218, 229, 144/230, 231, 236, 221; 403/377, 378; 407/42, 46, 47, 49, 106, 108; 83/698.41

(56) References Cited

U.S. PATENT DOCUMENTS 3,032,152 A * 5/1962 Titsler ..... 407/108
3,467,416 A * 9/1969 Gourley ..... 144/230
4,078,868 A * 3/1978 Erkfritz ..... 407/108
4,329,091 A * 5/1982 Erkfritz ..... 407/108
4,830,073 A * 5/1989 DeAbrew ..... 144/221
5,558,142 A * 9/1996 Ehrle et al. ..... 144/230
5,816,751 A * 10/1998 Frecska ..... 407/108

* cited by examiner

*Primary Examiner*—W Donald Bray

(57) ABSTRACT

A helical knife assembly has a plurality of blade holders. Each blade holder has two opposite step flanges, a blind hole, and a threaded groove communicating with the blind hole. A positioning block has a slant recess and two apertures. An oblong blade has two positioning holes. A pressing block has a bevel and an inner threaded hole. A hollow double end bolt has a first outer thread and a second outer thread. The positioning block is inserted in the respective blade holder. The oblong blade is disposed on the positioning block. The first outer thread of the hollow double end bolt is inserted in the threaded grooves The second outer thread of the hollow double end bolt engages with the inner threaded hole of the pressing block.

1 Claim, 6 Drawing Sheets

HELICAL KNIFE ASSEMBLY

BACKGROUND OF THE INVENTION

The present invention relates to a helical knife assembly. More particularly, the present invention relates to a helical knife assembly which can replace, a blade easily.

Referring to FIGS. 1 and 2, a conventional helical knife assembly 10 has a plurality of blade holders 11. Each of the blade holders 11 receives a blade 12. The blade 12 is soldered on the blade holder 11. It is difficult to replace the blade 12 when the blade 12 is broken.

SUMMARY OF THE INVENTION

An object of the present invention is to provide a helical knife assembly which has a plurality of blades to be replaced easily.

Accordingly, a helical knife assembly comprises a plurality of blade holders. Each of the blade holders has two opposite step flanges, a blind hole, and a threaded groove communicating with the blind hole. A positioning block has a slant recess and two apertures. An oblong blade has two positioning holes. A pressing block has a bevel and an inner threaded hole. A hollow double end bolt has a first outer thread and a second outer thread. The positioning block is inserted in the corresponding blade holder. The oblong blade is disposed on the positioning block. Two pins are inserted in the apertures of the positioning block and the positioning holes of the oblong blade. The first outer thread of the hollow double end bolt is inserted in the threaded groove of the corresponding blade holder. The second outer thread of the hollow double end bolt engages with the inner threaded hole of the pressing block. The bevel is inserted in the slant recess of the positioning block.

DETAILED DESCRIPTION OF THE INVENTION

Figure 1:
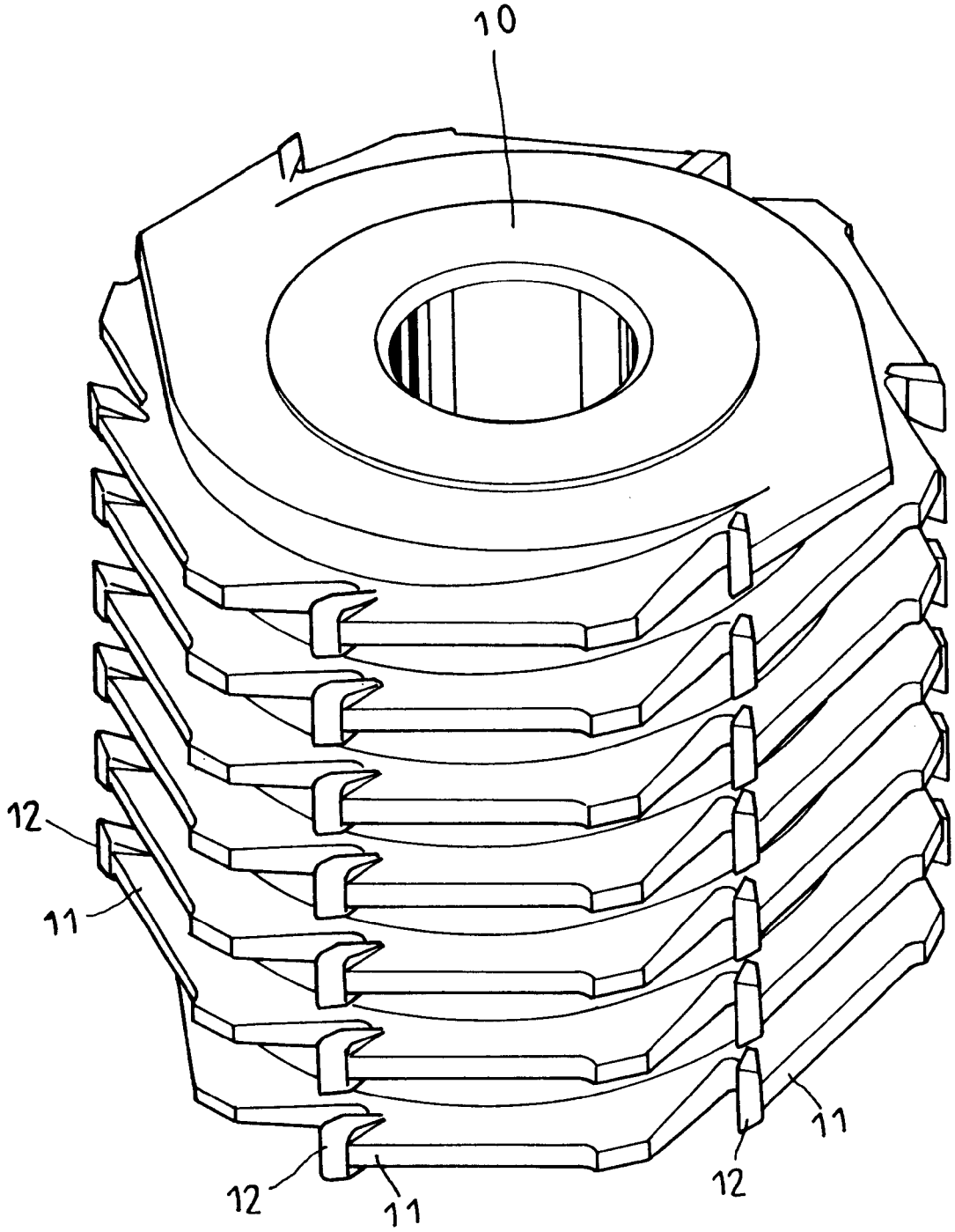
F I G. 1 PRIOR ART
FIG. 1 is a perspective view of a conventional helical knife assembly of the prior art.
Figure 2:
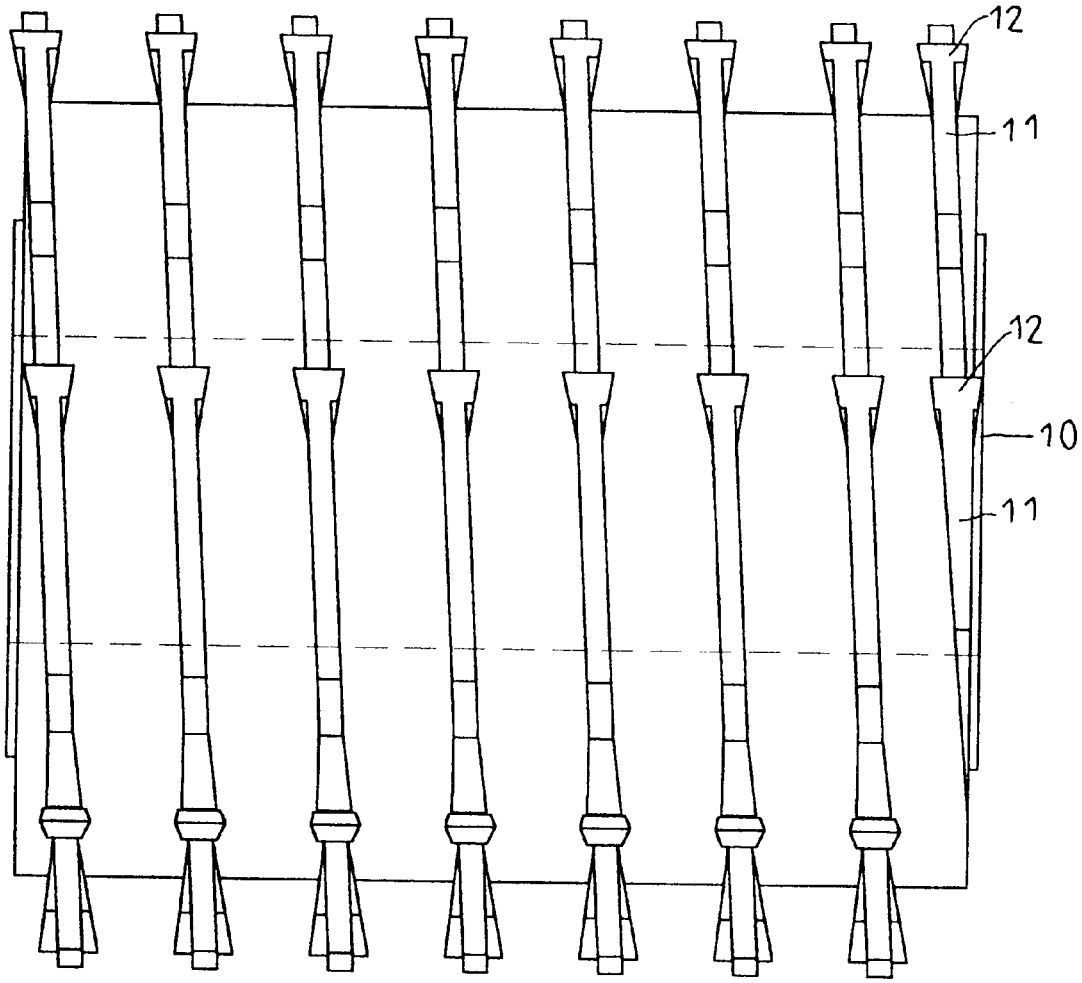
FIG. 2 PRIOR ART
FIG. 2 is an elevational view of a conventional helical knife assembly of the prior art.
Figure 2A:
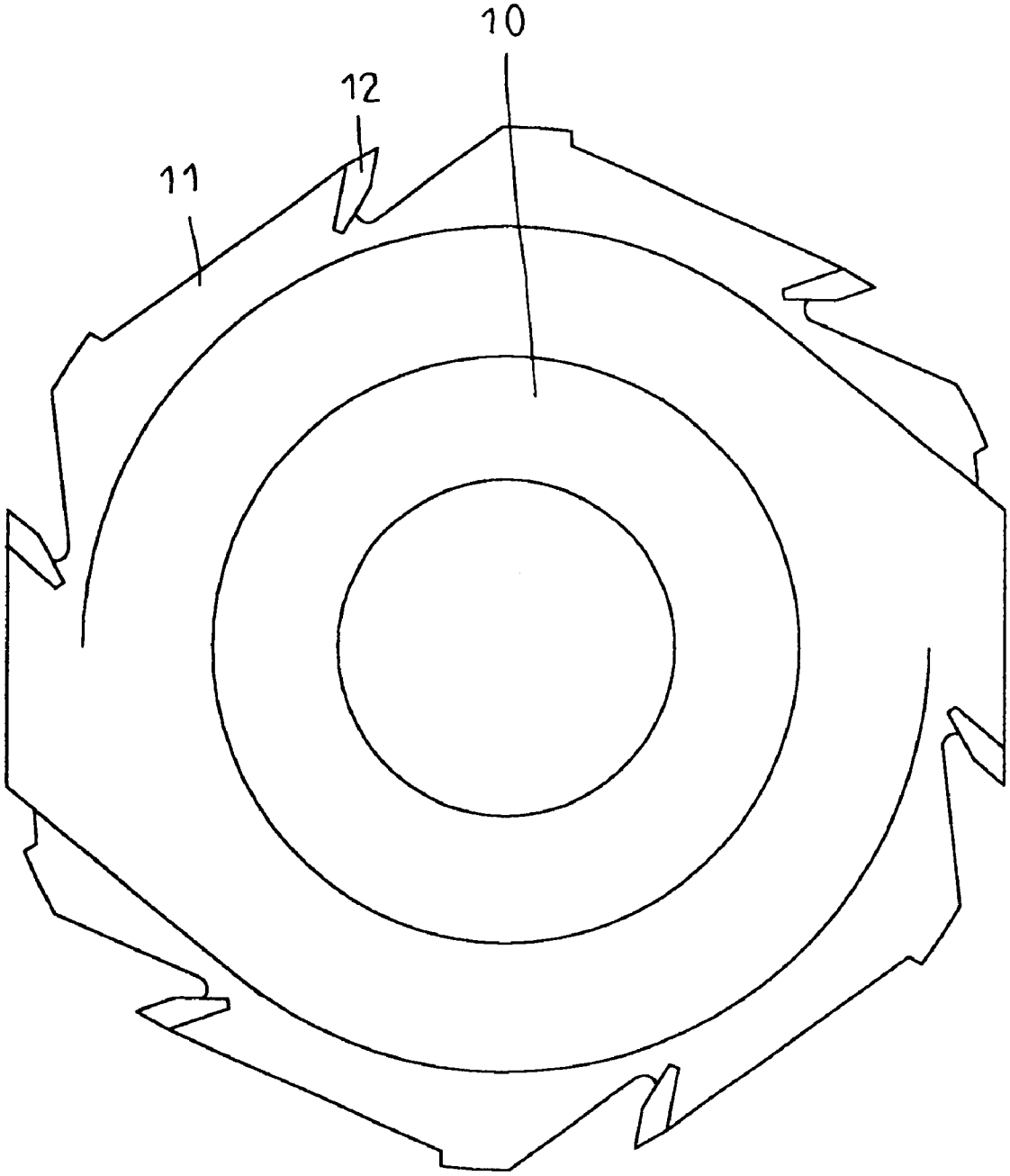
FIG. 2A PRIOR ART
FIG. 2A is a top plan view of a conventional helical knife assembly of the prior art.
Figure 3:
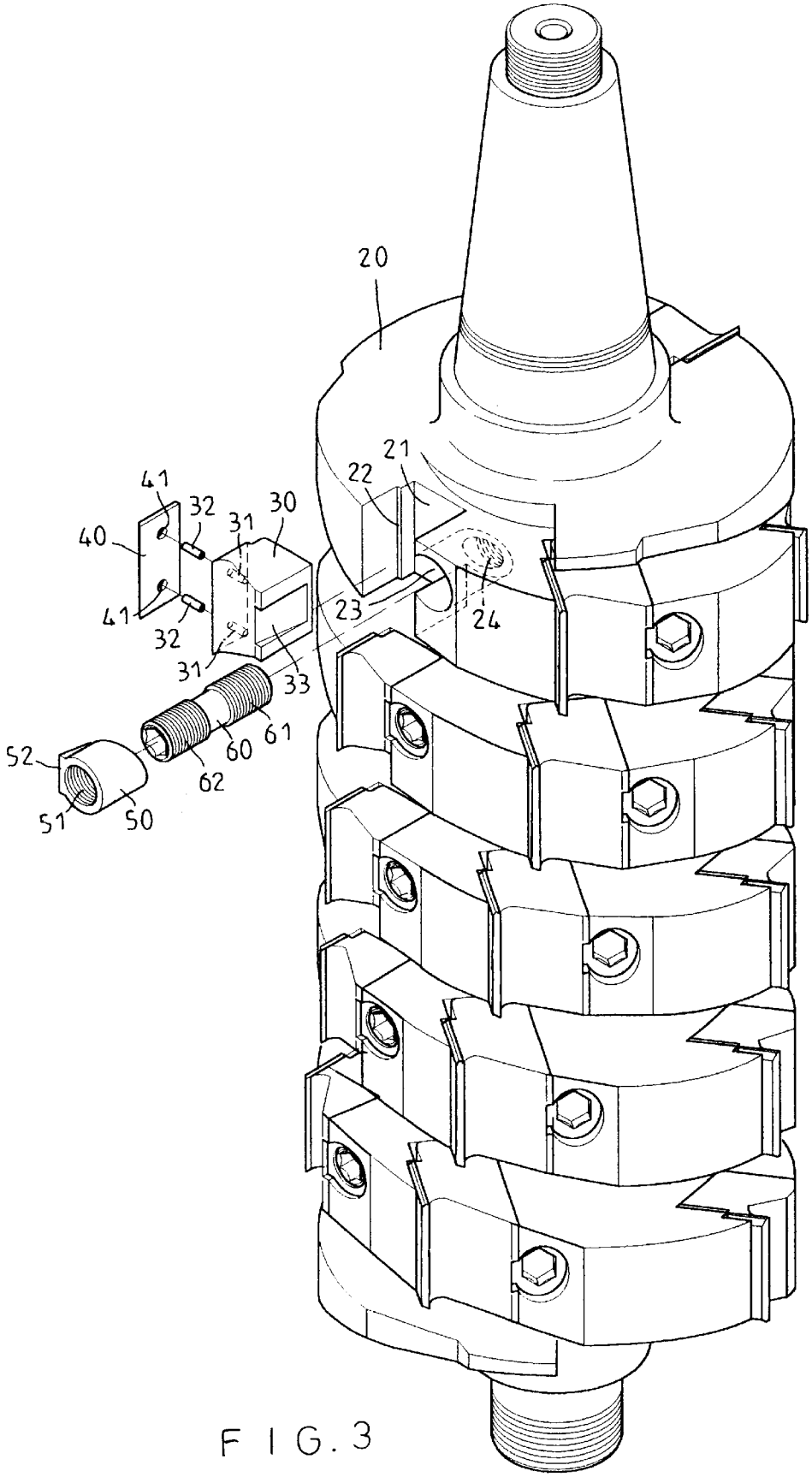
FIG. 3 is a perspective exploded view of a helical knife assembly of a preferred embodiment in accordance with the present invention.
Figure 4:
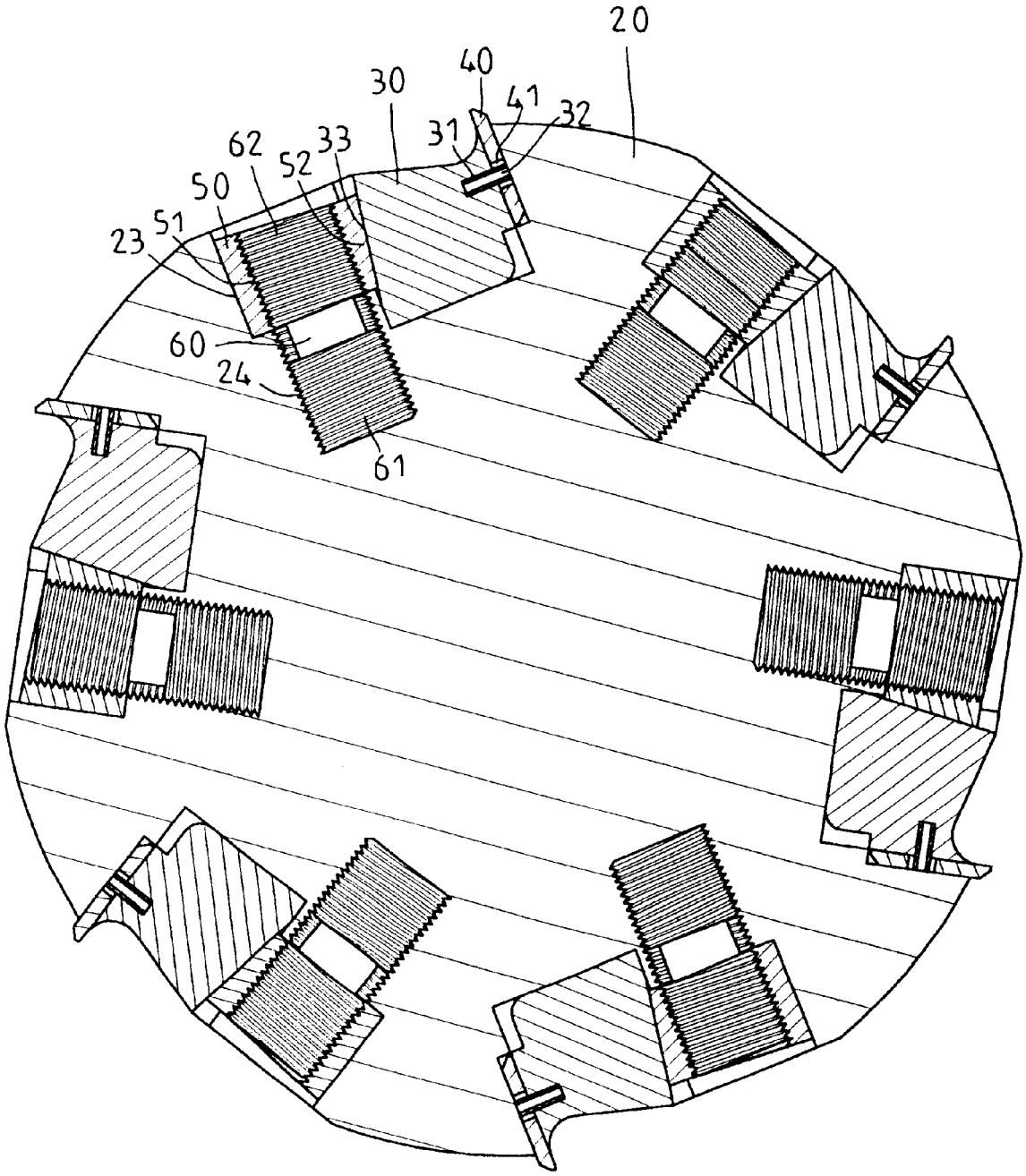
FIG. 4 is a sectional assembly view of a helical knife assembly of a preferred embodiment in accordance with the present invention.
Figure 5:
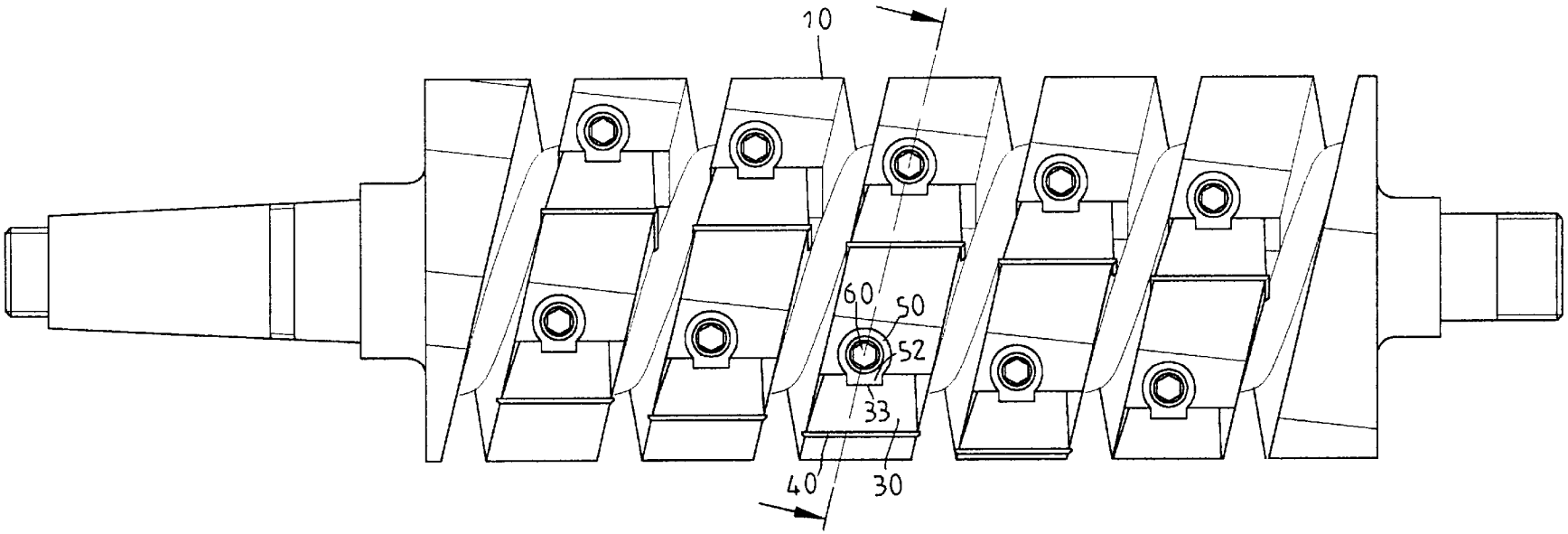
FIG. 5 is a schematic view illustrating an operation of a helical knife assembly of a preferred embodiment in accordance with the present invention.

Referring to FIGS. 3 to 5, a helical knife assembly 20 comprises a plurality of blade holders 21.

Each of the blade holders 21 has two opposite step flanges 22, a blind hole 23, and a threaded groove 24 communicating with the blind hole 23.

A positioning block 30 has a slant recess 33 and two apertures 31.

An oblong blade 40 has two positioning holes 41.

A pressing block 50 has a bevel 52 and an inner threaded hole 51.

A hollow double end bolt 60 has a first outer thread 61 and a second outer thread 62.

The positioning block 30 is inserted in the corresponding blade holder 21.

The oblong blade 40 is disposed on the positioning block 30.

Two pins 32 are inserted in the apertures 31 of the positioning block 30 and the positioning holes 41 of the oblong blade 40.

The first outer thread 61 of the hollow double end bolt 60 is inserted in the threaded groove 24 of the corresponding blade holder 21.

The second outer thread 62 of the hollow double end bolt 60 engages with the inner threaded hole 51 of the pressing block 50.

The bevel 52 is inserted in the slant recess 33 of the positioning block 30.

The invention is not limited to the above embodiment but various modification thereof may be made. Further, various changes in form and detail may be made without departing from the scope of the invention.

I claim:

1. A helical knife assembly comprising:

a plurality of blade holders, each of the blade holders having two opposite step flanges, a blind hole, and a threaded groove communicating with the blind hole, a positioning block having a slant recess and two apertures, an oblong blade having two positioning holes, a pressing block having a bevel and an inner threaded hole, a hollow double end bolt having a first outer thread and a second outer thread, the positioning block inserted in the corresponding blade holder, the oblong blade disposed on the positioning block, two pins inserted in the apertures of the positioning block and the positioning holes of the oblong blade, the first outer thread of the hollow double end bolt inserted in the threaded groove of the corresponding blade holder, the second outer thread of the hollow double end bolt engaging with the inner threaded hole of the pressing block, and the bevel inserted in the slant recess of the positioning block.

* * * * *